US007836561B2

(12) United States Patent
Vaccaro et al.

(10) Patent No.: US 7,836,561 B2
(45) Date of Patent: Nov. 23, 2010

(54) BUCKLE FOR DIVING GOGGLES OR THE LIKE

(75) Inventors: Gian Paolo Vaccaro, Rapallo (IT); Dante Noceti, Santa Margherita Ligure (IT)

(73) Assignee: Mares S.p.A., Rapallo (IT)

( * ) Notice: Subject to any disclaimer, the term of this patent is extended or adjusted under 35 U.S.C. 154(b) by 543 days.

(21) Appl. No.: 11/828,753

(22) Filed: Jul. 26, 2007

(65) Prior Publication Data

US 2008/0028578 A1 Feb. 7, 2008

(30) Foreign Application Priority Data

Aug. 2, 2006 (IT) ..... GE2006A0080

(51) Int. Cl.

| | |
|---|---|
| ***A62B 9/04*** | (2006.01) |
| ***B63C 11/02*** | (2006.01) |
| ***A41F 1/00*** | (2006.01) |
| ***A61F 9/02*** | (2006.01) |

(52) U.S. Cl. ..... 24/68 E; 24/170; 24/193; 2/450; 2/452; 351/43

(58) Field of Classification Search ..... None
See application file for complete search history.

(56) References Cited

U.S. PATENT DOCUMENTS

| | | | | |
|---|---|---|---|---|
| 4,727,630 | A | 3/1988 | Alan | |
| 5,915,541 | A | 6/1999 | Beltrani | |
| 6,185,794 | B1 | 2/2001 | Maggi | |
| 6,446,272 | B1 | 9/2002 | Lee | |
| 7,275,536 | B2 * | 10/2007 | Godoy | 128/207.11 |
| 2006/0015990 | A1 | 1/2006 | Chiang | |

FOREIGN PATENT DOCUMENTS

| | | |
|---|---|---|
| FR | 2 868 326 | 10/2005 |

OTHER PUBLICATIONS

European Search Report for European Application No. 07113267.4, Jul. 5, 2010, European Patent Office, Rijswijk, Netherlands.

* cited by examiner

*Primary Examiner*—Jack W. Lavinder
(74) *Attorney, Agent, or Firm*—Stites & Harbison PLLC; Marvin Petry

(57) ABSTRACT

Buckle for adjusting the strap in equipment for practicing water sports, such as diving goggles, swimming goggles or the like, said strap being provided at at-least one end with a plurality of transverse reliefs, said buckle comprising a body provided with means for driving said end of the strap and with an engaging tooth which is normally kept in a position engaged with said reliefs of said strap, against said drive means, there being envisaged operating means able to disengage said engaging tooth from said reliefs, comprising means with an inclined surface co-operating with said engaging tooth and movable in a direction substantially parallel to the longitudinal axis of the end of said belt.

10 Claims, 3 Drawing Sheets

BUCKLE FOR DIVING GOGGLES OR THE LIKE

BACKGROUND OF THE INVENTION

1. Field of the Invention

The present invention relates to a buckle for water sports equipment and in particular relates to a buckle for diving goggles, swimming goggles or the like.

2. Description of Related Art

The buckles which are used in water sports equipment such as diving goggles, swimming goggles or the like must generally satisfy two main requirements: ease of adjustment of the length of the strap, both when shortening and increasing the length, and a minimum dimensional volume. While, with regard to this latter aspect, there have never been major problems designing buckles which sufficiently small dimensions, on the other hand combining this feature with efficient ease of use has always been problematic.

EP 824029 discloses a buckle for straps of diving goggles or the like in which a toothed strap, namely a strap with substantially equidistant reliefs oriented perpendicularly with respect to its longitudinal axis, co-operates with a buckle provided with means for engagement with said strap in the form of a ratchet mechanism able to co-operate with said teeth of the strap, so as to allow sliding thereof during shortening, namely when the strap is tightened around the diver's head, and having an operating lever which allows disengagement of said mechanism from the said teeth so as to allow sliding of the strap in the opposite direction. This type of device has disadvantages of two kinds: firstly the pivoting point of said lever is subject to a high degree of wear and breakage. Moreover, in order to obtain a configuration which allows effective operation by the diver, the lever must project considerably, thereby resulting in a considerable lateral volume of the goggles; lastly, the operation is somewhat awkward to perform.

The document U.S. Pat. No. 4,727,630 describes a buckle made of plastic and consisting of a single moulded part with a strap insertion passage defined by top and bottom walls facing each other and side walls also facing each other. The front wall of the buckle has an engaging portion defined by an opening in the form of a U-shaped slit. The engaging portion is elastically deformable and has an engaging tooth provided on the inner side of its end portion. The side walls are provided with side holes communicating with the strap insertion passage. Operating means penetrate inside the side holes, it being necessary for them to be elastically deformed inwards in order to enter into contact with the side portions of the engaging portion, so as to allow an upwards displacement of the free end of the engaging portion.

This device has clear advantages compared to the device described previously, but also has some obvious drawbacks; in fact, if on the one hand a small overall volume and reasonable ease of operation are ensured, on the other hand it must be considered that in this case neither has it been possible to provide a device which is completely safe and free of the problems due to accidental release. It must be pointed out that, in particular in the case of diving goggles, the device considered is one where being able to control the position is of primary importance.

BRIEF SUMMARY OF THE INVENTION

The object of the present invention is, therefore, to provide a buckle which is able to overcome the drawbacks as encountered in the devices at present commercially available and which has an extremely compact and reliable structure, and in particular is free from the risk of accidental release.

The present invention therefore relates to a buckle for adjusting the strap in equipment for practicing water sports, such as diving goggles, swimming goggles or the like, said strap being provided at least one end with a plurality of transverse reliefs, said buckle comprising a body provided with means for driving said end of the strap and with an engaging tooth which is normally kept in a position engaged with said reliefs of said strap, against said drive means, there being envisaged operating means able to disengage said engaging tooth from said reliefs; said operating means comprise means with an inclined surface co-operating with said engaging tooth and movable in a direction substantially parallel to the longitudinal axis of the end of said strap.

In a preferred embodiment, said engaging tooth is situated at the free end of a resilient tongue which at the opposite end is connected to said body; preferably, said body, said tongue and said tooth are made as one piece and in particular of thermoplastic material. Said tongue is formed in a plane substantially parallel to the sliding plane of said strap and has a surface inclined with respect to said plane and co-operating with another surface, similarly inclined, connected to a movable member coupled, via suitable guide means, to the body of said buckle. In particular, said inclined surface of said tongue is a slit with inclined walls, formed transversely with respect to the said tongue, and co-operating with an inclined lug projecting from said movable member.

BRIEF DESCRIPTION OF THE SEVERAL VIEWS OF THE DRAWINGS

Further advantages and characteristic features of the device according to the present invention will emerge from the following detailed description of an embodiment thereof provided by way of a non-limiting example with reference to the accompanying plates of drawings in which.

DETAILED DESCRIPTION OF THE INVENTION

Figure 1:
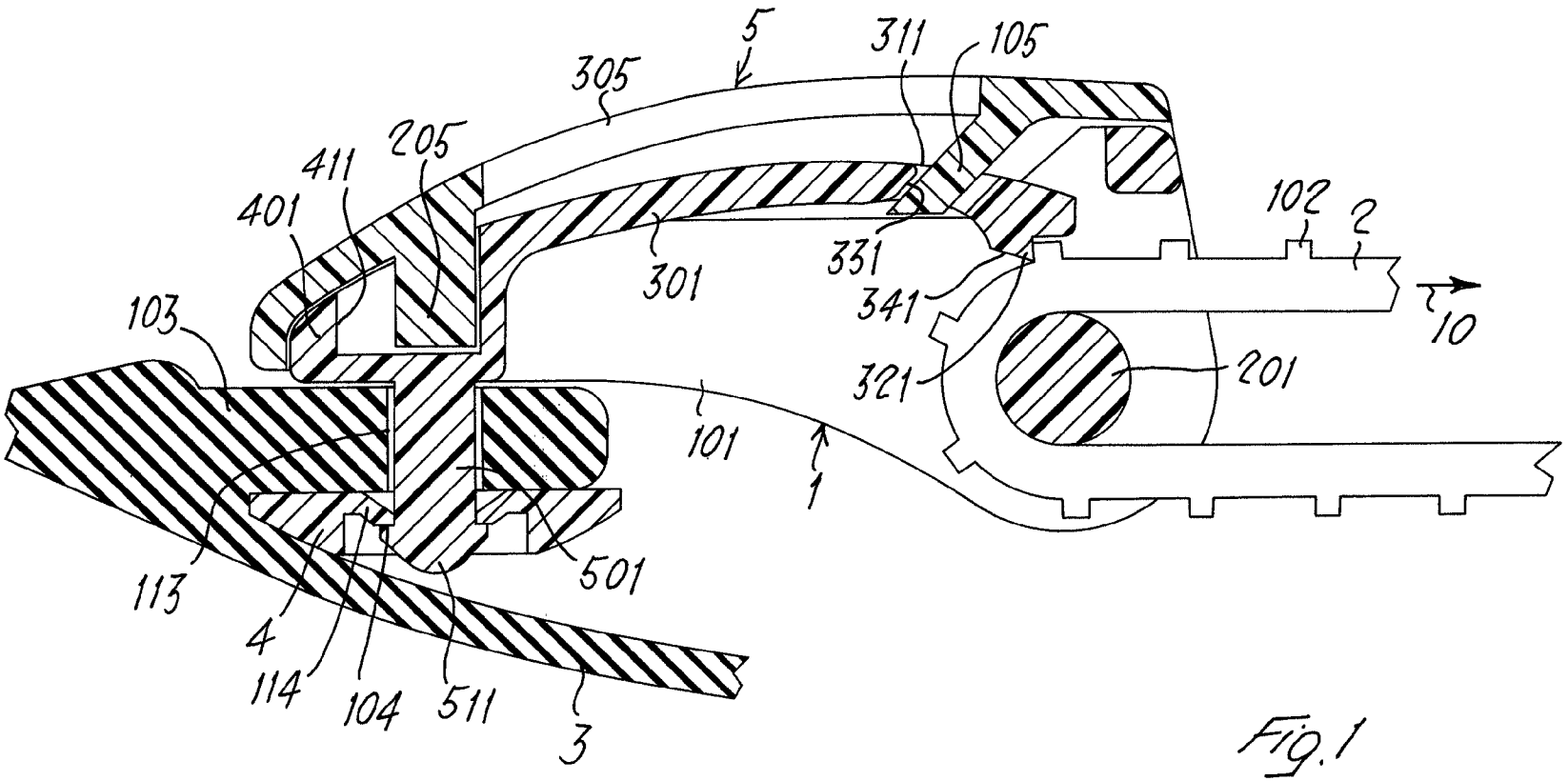
FIG. 1 is a longitudinally sectioned view of a buckle according to the present invention.

FIG. 1 shows an embodiment of the buckle according to the present invention; 1 denotes the body of the said buckle. Said body 1 has two side walls which at one end converge in a head 401 having, extending therefrom, the pin 501 which allows connection to the sports equipment, i.e. in this case the goggles 3, by means of insertion inside the eyelet 113 in the portion 103; the pin 501 is fastened to the eyelet 113 by means of the introduction of the mushroom-shaped end 511 of the same pin 501 inside the hole 104 of the button 4 provided with snap-engaging walls 114.

At the opposite end the side walls 101 of the body 1 carry the drive roller 201 over which the strap 2 with reliefs 102 slides; said reliefs engage with the engaging tooth 321 projecting from the free end of the tongue 301 and provided with the inclined wall 341, said tongue at the opposite end being connected to the head 401 of the body 1 and having, in the vicinity of the engaging tooth 321, the slit 311 provided with inclined transverse walls 331. The slider 5 is arranged on the body 1 and has a wide central opening 305; at one end it is provided with a pin 205 which engages inside the cavity 411 formed in the head 401 of the body 1, while in the vicinity of the opposite end said slider has a lug 105 which is inclined with respect to the sliding plane of the strap 2 at an angle similar to that of the transverse walls 331 of the slit 311 and engaged inside the said slit 311.

Figure 2:
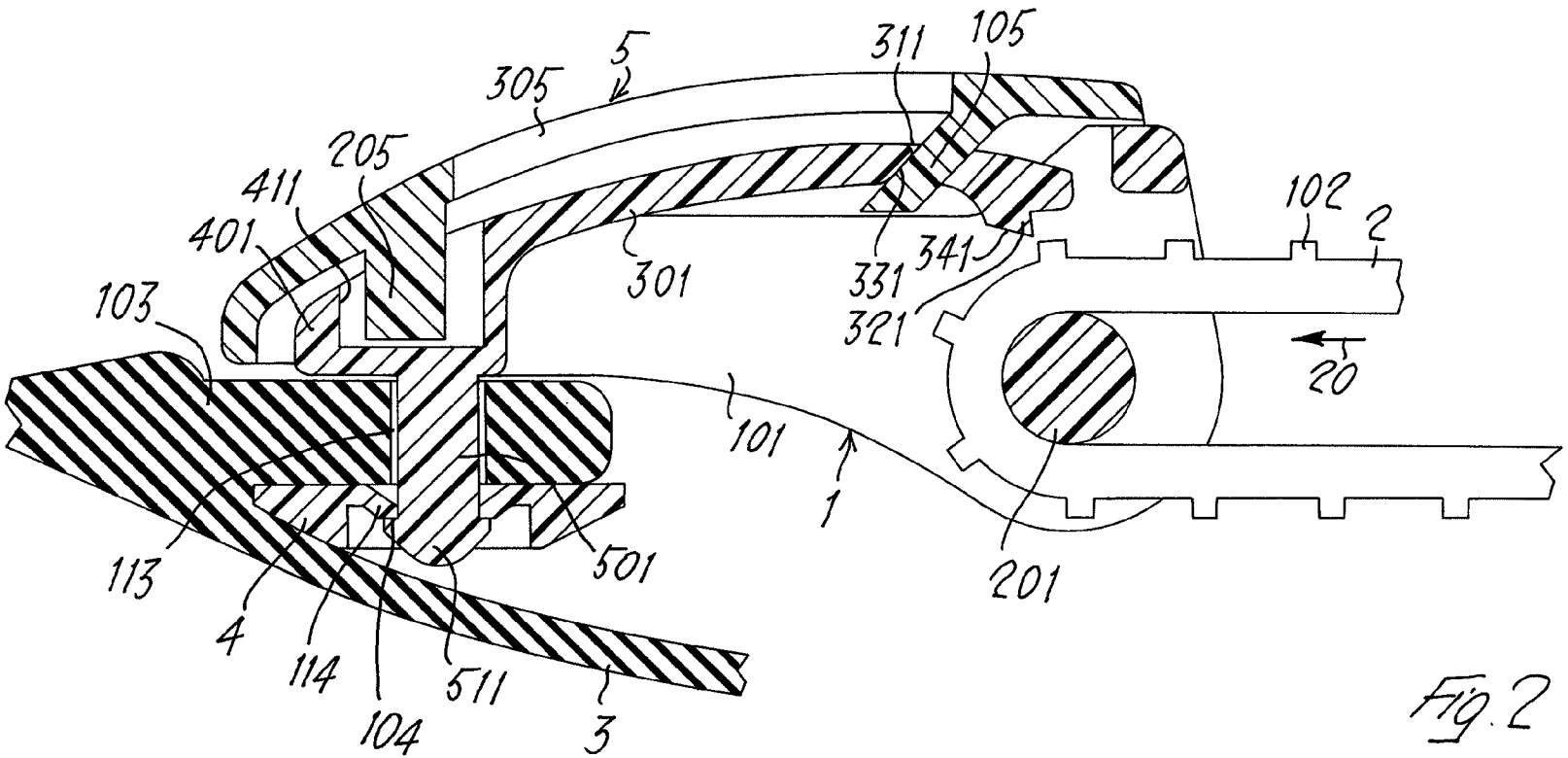
FIG. 2 is a view, similar to that of FIG. 1, showing a different stage of operation of the buckle according to the present invention.

As can be seen from FIG. 2, where the same parts are indicated by the same number, when the slider 5 is displaced forwards towards the head 401 of the body 1, the lug 105 of the slider comes into contact with the wall 331 of the slit 311 and, as a result of this co-operation, the engaging tooth is released from its engagement with the relief 102 of the strap 2.

Figure 3:
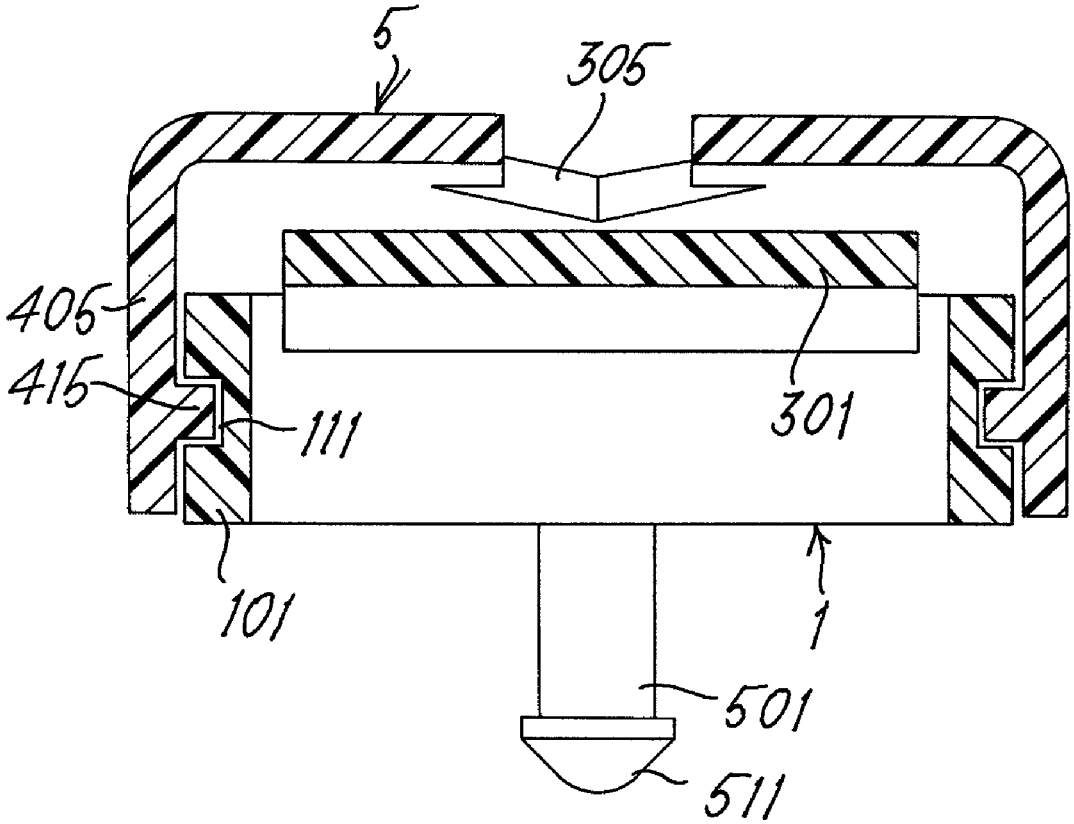
FIG. 3 is a cross-sectional view along the line III-III of FIG. 1.

FIG. 3 shows a cross-section along the line III-III in FIG. 1; identical parts are indicated by the same numbers. The way in which the slider 5 is guided on the body 1 can be seen more clearly in this figure; the side walls 405 of the slider 5 are provided, on the side directed towards the body 1, with longitudinal reliefs 415 which co-operate with the grooves 111 formed on the side walls 101 of the said body 1.

The operating principle of the device according to the present invention will become clear from the description below. As mentioned above, the buckle as shown in FIG. 1 has the effect that the engaging tooth 321 allows sliding of the strap 2 only in the direction of the arrow 10, namely so as to shorten the strap around the diver's head. This operation, which is in fact common for most of the types of buckle which are commercially available, is allowed by the form of the engaging tooth 321, which has an inclined wall 341 so as to favour travel of the reliefs 102 in the predetermined direction. When, instead, the diver intends adjusting the strap so as to lengthen it, the slider 5 must be displaced towards the head 401 of the body 1 so that the inclined lug 105 comes into contact with the inclined wall 331 of the slit 311 and causes raising of the end of the tongue 301 which has the engaging tooth 321. In this way, as is clear from FIG. 2, the strap is able to slide in the direction of the arrow 20 and its length may therefore be conveniently adjusted.

As can be noted, the buckle according to the present invention has an extremely small dimensional volume and does not have any projecting part able to create an obstruction or likely to get tangled in any way with other parts of the diver's equipment. The movement which allows release of the engaging tooth is completely guided, as can be seen in FIG. 3, and balancing of the forces makes it completely symmetrical, so as to prevent sticking which with other types of devices would be attributable to not properly distributed application of the force.

Advantageously this type of buckle may be easily adapted to different types of equipment for water sports, such as diving and swimming goggles preferably, and in particular may be easily coupled with a lug projecting directly from the face-piece of the diving or swimming goggles.

The invention claimed is:

1. A strap combined with a buckle for attaching the strap to equipment, comprising:

the buckle having a body, the buckle body having an elongated member over which the strap is mounted and is movable in one direction to lengthen the strap and in the opposite direction to shorten the strap, the strap having reliefs extending generally parallel to the elongated direction of the elongated member, a tongue connected to the buckle body and extending from a location near the remote end of the buckle towards the elongated member and a tooth mounted on the end of the tongue, said tooth engaging a relief to secure the strap to prevent movement of the strap of the lengthening direction while permitting movement of the strap in the shortening direction, the tongue extending in a direction substantially parallel to the direction of elongation of the buckle, the tongue having a slit with transverse walls, one of said walls forming a first inclined surface which is inclined relative to the direction of elongation of the buckle, a release member also extending substantially parallel to the direction of elongation of the buckle, the release member having a lug which forms a second inclined surface which engages the first inclined surface to cause the release of the tooth from its relief, and the buckle being generally elongated from the elongated member to a remote end spaced from the elongated member in a direction away from the strap, the release member being moveable substantially parallel to the direction of elongation of the buckle to release the tooth from the relief.

2. The combination of claim 1, wherein the equipment is water sports goggles, and the lengthening direction of the strap loosens or releases the strap and goggles from the user's head and the shortening direction of the strap attaches or tightens the goggles to the user's head.

3. The combination of claim 1, wherein the body, the tongue and the tooth are made as one piece.

4. The combination of claim 3, wherein the one piece is a thermoplastic material.

5. The combination of claim 1, including a guide surface on the buckle body which engages a mating guide surface on the release member to guide the release member relative to the body.

6. A buckle for adjusting a strap for use in water sports equipment, wherein the strap is mounted on a roller and extends in a longitudinal direction, the buckle having a body which includes a tooth which engages a relief on the strap to prevent lengthening of the strap, an operating device mounted to operatively engage the tooth to release it from its relief to permit lengthening of the strap, the operating device including a lug with a first inclined surface which operatively engages the tooth to release it from its relief upon movement of the operating device in a direction substantially parallel to the longitudinal direction of the strap, and the buckle body including a tongue, the tooth being located at the end of the tongue, the tongue having a slit, one wall of the slit forming a second inclined surface which is engaged by the first inclined surface to cause the release of the tooth from its relief.

7. A buckle according to claim 6, wherein the water sports equipment comprises water sports goggles, and the lengthening direction of the strap loosens or releases the strap and goggles from the user's head and the shortening direction of the strap attaches or tightens the goggles to the user's head.

8. A buckle according to claim 6, wherein the body, the tongue and tooth are made as one piece.

9. A buckle according to claim 8, wherein the one piece is a thermoplastic material.

10. A buckle according to claim 6, including a guide surface on the body which engages a mating guide surface on the operating device to guide the operating device relative to the body.

* * * * *